US008910571B2

(12) United States Patent
Fujiwara

(10) Patent No.: US 8,910,571 B2
(45) Date of Patent: Dec. 16, 2014

(54) DAMPENING UNIT IN OFFSET PRINTING PRESS

(75) Inventor: Reishi Fujiwara, Daisen (JP)

(73) Assignee: Miyakoshi Printing Machinery Co., Ltd., Narashino-shi (JP)

( * ) Notice: Subject to any disclaimer, the term of this patent is extended or adjusted under 35 U.S.C. 154(b) by 815 days.

(21) Appl. No.: 11/876,197

(22) Filed: Oct. 22, 2007

(65) Prior Publication Data

US 2008/0092759 A1 Apr. 24, 2008

(30) Foreign Application Priority Data

Oct. 23, 2006 (JP) ..... 2006-287649

(51) Int. Cl.
*B41F 7/26* (2006.01)
*B41F 7/40* (2006.01)

(52) U.S. Cl.
CPC .... *B41F 7/26* (2013.01); *B41F 7/40* (2013.01)
USPC ..... 101/148

(58) Field of Classification Search
None
See application file for complete search history.

(56) References Cited

U.S. PATENT DOCUMENTS 4,944,223 A 7/1990 Ishii et al.
4,986,176 A 1/1991 Ishii et al.
5,062,362 A 11/1991 Kemp
5,435,243 A * 7/1995 Makino et al. ..... 101/148
2003/0172818 A1* 9/2003 Motard ..... 101/148

FOREIGN PATENT DOCUMENTS

JP 2882966 B2 4/1999

OTHER PUBLICATIONS

European Search Report issued Aug. 5, 2009 in corresponding European Patent Application 07254100.

* cited by examiner

*Primary Examiner* — Joshua D Zimmerman
(74) *Attorney, Agent, or Firm* — Westerman, Hattori, Daniels & Adrian, LLP

(57) ABSTRACT

It is desirable that ink and water be fully kneaded or distributed together when an inking unit 4 and a dampening unit 5 are in communication with each other. Accordingly, a dampening water communication path 17 which brings the inking unit 4 and the dampening unit 5 in and out of communication so that they can come in and out of contact with each other is provided, the dampening water communication path comprises a plurality of rollers including an oscillating roller 14 in rotational contact with an ink distributing roller 8 and an oscillating roller 16 in rotational contact with a dampening roller 10, and a roller interposed between them is a bridging roller 15 in rotational contact with one of these adjoining rollers and capable of coming in and out of contact with the other.

2 Claims, 2 Drawing Sheets

PRIOR ART

PRIOR ART

DAMPENING UNIT IN OFFSET PRINTING PRESS

TECHNICAL FIELD

The present invention relates to a dampening unit for use in an offset printing press and, more particularly, to a dampening unit whereby dampening water alone or together with ink can switchably be furnished onto a printing plate via a dampening roller in rotational contact therewith.

BACKGROUND ART

The conventional dampening unit of this sort is so designed as shown in FIG. 1 in which a dampening roller c which is in rotational contact with a printing plate a and furnishes the printing plate a with dampening water supplied from a water fountain roller b is furnished with ink via an ink accepting roller d from one inking roller $f_1$ of a plurality of inking rollers $f_1$, $f_2$ of an inking unit e, which are in rotational contact with the printing plate a. And, the ink accepting roller d is adapted to come in and out of contact with the inking roller $f_1$ so that with such ink accepting roller d coming in and out of contact, the dampening roller c may furnish the printing plate a with dampening water alone from a water pan g or together with ink from the inking unit e. Shown also in the Figure are a metering roller h in rotational contact with the water fountain roller b and an oscillating roller i in rotational contact with the inking rollers f1, f2 for supplying them with ink.

The modes of furnishing dampening water are changed over in accordance with an image area factor of a print.

To wit, printing as desired requires dampening water to be furnished in the form of a film of uniform thickness onto the printing plate a and to be emulsified (mixed with ink) moderately in the inking unit e. And, such state of emulsification varies with a mode of furnishing water onto the printing plate a and also with an image area factor of a print. Accordingly, if the image area of a print is small, the ink accepting roller d is then spaced from the dampening roller c so that dampening water is directly furnished onto the printing plate a from the dampening roller c. Also, if the print image area is large, then the ink accepting roller d is brought into contact with the dampening roller c so that the dampening roller c furnishes the printing plate a with both water and ink (see JP Patent No. 2882966).

In the conventional dampening unit mentioned above, the ink supply path for a dampening roller is constituted by using only a single roller (ink accepting roller) which is adapted to come into and out of contact with the dampening roller. Thus, ink furnished onto the dampening roller is not fully kneaded in the ink supply path and not fully kneaded either in the water supply path from the dampening roller onto the inking roller. As a result, the problems arise that ink and water on both the dampening roller and the inking roller can hardly be filmed and emulsified and that if the printing plate is furnished with both water and ink as the image area factor becomes larger, then an excessive emulsification goes on to occur quickly so that occurrence of a printing stain soon appears.

With these problems taken into, it is an object of the present invention to provide a dampening unit in an offset printing press in which ink and water are fully kneaded or distributed together when the apparatus is brought into communication with the inking unit and ink can moderately be emulsified on a dampening roller and an inking roller in a mode of furnishing water in which water together with ink is furnished on a printing plate from the inking roller and the dampening roller.

DISCLOSURE OF THE INVENTION

In order to achieve the object mentioned above, there is provided in accordance with the present invention a dampening unit in a offset printing press in which a printing plate which is furnished with ink by an inking unit comprising an ink distributing roller, an ink oscillating roller and an inking roller, which is furnished continuously with dampening water via a water fountain roller, a metering roller and a dampening roller and which is provided with a dampening water communication path adapted to supply and cease supplying the inking roller with dampening water from the dampening roller, characterized in that: the dampening water communication path comprises a plurality of rollers including an oscillating roller in rotational contact with the ink distributing roller and an oscillating roller in rotational contact with the dampening roller and a roller interposed between them which is a bridging roller in rotational contact with one of these adjoining rollers and capable of coming in and out of contact with the other.

The roller in rotational contact with the dampening roller in the makeup mentioned above is a distributing or kneading roller.

According to the present invention, in an offset printing press, in a dampening unit which is provided separately of an inking unit and is adapted to be connected to and disconnected from the inking unit by a dampening water communication path, the dampening water communication path in the dampening unit comprises a plurality of rollers provided between a dampening roller in the dampening unit and an ink kneading or distributing roller in the inking unit and they include oscillating rollers in rotational contact with the ink kneading or distributing roller and the dampening roller, respectively, and an bridging roller interposed between the rollers whereby when the ink kneading or distributing roller is in communication with the dampening roller with the bridging roller connected thereto, an elongated path for dampening water to travel from the dampening roller to the inking roller can make an appropriate emulsified state of ink at an interface between the inking roller and a printing plate and make a print large in image area factor stably over an extended time period.

Also, where with the bridging roller isolated, dampening water is furnished onto the printing plate only from the dampening roller, the oscillating or distributing roller and the oscillating roller which remain in rotational contact with the dampening roller and the ink distributing roller, respectively, can act as distributing rollers so that water supplied onto the printing plate from the dampening roller and ink supplied onto the printing plate from the inking roller are well kneaded or distributed together and in such state furnished onto the printing plate.

BEST MODES FOR CARRYING OUT THE INVENTION

Figure 1:
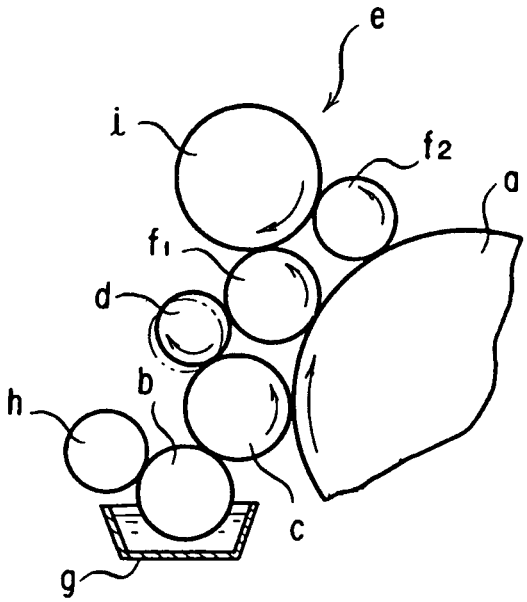
FIG. 1 is an explanatory view illustrating the prior art.
Figure 2:
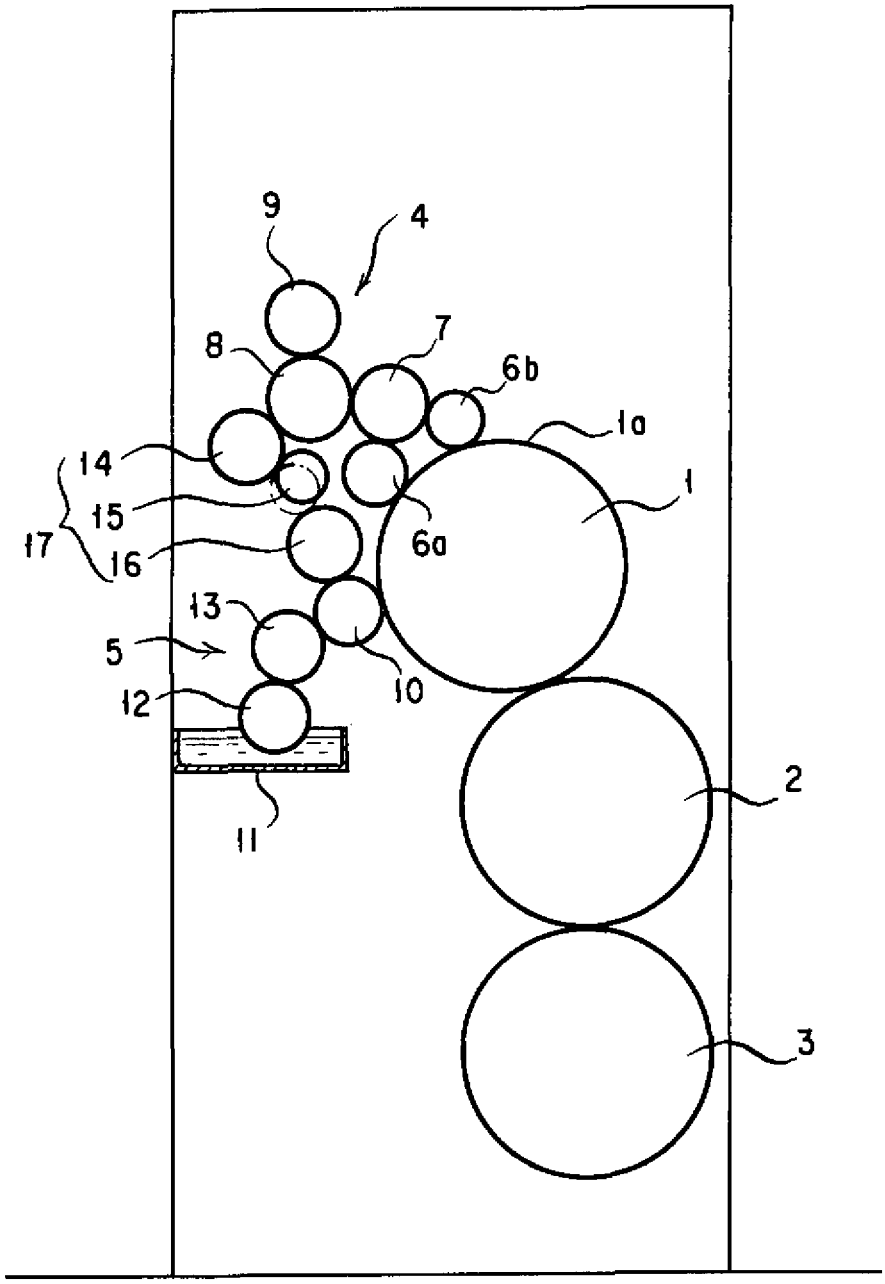
FIG. 2 is an explanatory view illustrating a form of implementation of the present invention.

FIG. 2 shows a printing unit in an offset printing press in which there are shown a plate cylinder 1, a blanket cylinder 2 and an impression cylinder 3. And, numeral 4 designates an inking unit for furnishing ink onto a printing plate 1*a* on a surface of the plate cylinder 1 and numeral 5 denotes a dampening unit for furnishing dampening water onto the printing plate 1*a*.

The inking unit 4 comprises a pair of inking rollers 6*a* and 6*b* each in rotational contact with the printing plate 1*a*, an ink oscillating roller 7 in rotational contact with both the two inking rollers 6*a* and 6*b*, an ink kneading or distributing roller 8 in rotational contact with the ink oscillating roller 7 and an ink supply and kneading or distributing roller 9 upstream of and in rotational contact with the ink kneading roller 8.

The dampening unit 5 has a dampening roller 10 in rotational contact with the printing plate 1*a*, and a water fountain roller 12 and a metering roller 13 for supplying the dampening roller 10 with dampening water from a water pan 11. And, the dampening roller 10 in this dampening unit 5 communicates with the ink kneading roller 8 via a dampening water communication path 17 comprising a first water oscillating roller 14 in rotational contact with the ink kneading roller 8 in the inking unit 4, a bridging roller 15 and a second water oscillating roller 16. The bridging roller 15 is constantly in rotational contact with the first water oscillating roller 14 but is adapted to come into and out of contact with the second water oscillating roller 16.

In the makeup mentioned above, when the bridging roller 15 in the dampening water communication path 17 is spaced away from the second water oscillating roller 16, communication between the inking unit 4 and the dampening unit 5 is cut off. Consequently, ink supplied onto the ink kneading roller 8 is furnished onto the printing plate 1*a* via the ink oscillating roller 7 and the inking rollers 6*a* and 6*b*. Then, the first water oscillating roller 14 in rotational contact with the ink kneading roller 8 remains unfurnished with water from the dampening unit 5 so that the ink kneading roller 8 acts to knead or distribute ink on the surface of the ink oscillating roller 7 circumferentially and axially while uniformly distributing the ink in these directions.

On the other hand, dampening water from the water pan 11 is then furnished onto the printing plate 1*a* directly via the dampening roller 10. And, dampening water then on the surface of the dampening roller 10 is metered by the metering roller 13 and at the same time is distributed uniformly not only circumferentially as a matter of course but also axially.

Next, if in the dampening water communication path 17 the bridging roller 5 in rotational contact with the first water oscillating roller 14 is moved to rotationally contact with the second water oscillating roller 16, then the dampening roller 10 in the dampening unit 5 and the ink distributing roller 8 are brought into communication with each other via the bridging roller 15.

This causes a part of dampening water supplied on the dampening roller 10 to be furnished onto the printing plate 1*a* directly via the dampening roller 10 and its other part to be move to between the two water oscillating rollers 16 and 14 via the bridging roller 15 and furnished to the ink distributing roller 8 and then to be moved from the ink distributing roller 8 onto the inking rollers 6*a* and 6*b* via the ink oscillating roller 7. Consequently, dampening water together with ink is furnished onto the printing plate 1*a* from the inking rollers 6*a* and 6*b*.

Then, ink on the ink distributing roller 8 in the inking unit 4 is moved to between two water oscillating rollers 14 and 16 via the bridging roller 15 and to the dampening roller 10 and is furnished onto the printing plate 1*a* together with dampening water from the dampening roller 10.

Since in the dampening water communication path 17 between the ink distributing roller 8 in the inking unit 4 and the dampening roller 10 in the dampening unit 5 when the bridging roller 15 in the dampening water communication path 17 is in rotational contact with the second water oscillating roller 16, namely when the inking unit 4 and the dampening unit 5 are brought into communication with each other, there are two oscillating rollers 14 and 16 and the bridging roller 15 interposed between them, and dampening water and ink moving through the communication path 17 are moved through this path while being fully kneaded and distributed by the two rollers 14 and 16 axially of these rollers.

And, an area in which the dampening roller 10 and the printing plate 1*a* are in rotational contact with each other when the bridging roller 15 is in rotational contact with the second water oscillating roller 16 is furnished on the printing plate 1*a* with dampening water supplied from the metering roller 13 and ink moved in the communication path 17 which are fully kneaded or distributed and moderately emulsified together in the communication path.

On the other hand, then in the inking unit 4, ink supplied from the ink supply and distributing roller 9 and dampening water from the communication path 17 join at the distributing roller 8 and then moving from the distributing roller 8 to the inking rollers 6*a* and 6*b* for supply onto the printing plate 1*a* from these inking rollers.

While in the form of implementation described above, the oscillating roller 16 is shown in rotational contact with the dampening roller 10, the oscillating roller 16 may be substituted by a kneading or distributing roller. Further, the rollers constituting the dampening water communication path are not limited to three as shown in FIG. 2 but may be more than three.

What is claimed is:

1. A dampening unit in an offset printing press in which a printing plate is furnished with ink by an inking unit comprising an ink distributing roller, an ink oscillating roller and a plurality of inking rollers;

said printing plate is furnished continuously with dampening water via a water fountain roller, a metering roller and a dampening roller;

wherein all of the inking rollers present in said offset printing press are provided with the same one dampening water communication path adapted to supply and cease supplying the inking rollers with dampening water from the dampening roller, wherein said same one dampening water communication path comprises a plurality of rollers including:

a first oscillating roller in rotational contact with said ink distributing roller;

a second oscillating roller in rotational contact with said dampening roller, said second oscillating roller is located downstream of a contact point between said dampening roller and said printing plate wherein said second oscillating roller is not in direct rotational contact with any of said plurality of the inking rollers provided in said inking unit, and at a location upstream of said contact point only the metering roller is in direct rotational contact with said dampening roller and the water fountain roller; and a roller interposed between the first oscillating roller and second oscillating roller is a bridging roller, the bridging roller being in rotational contact with one of the first oscillating roller and the second oscillating roller and capable of coming in and out of contact with the other one of the first oscillating roller and the second oscillating roller, wherein the first oscillating roller in the same one dampening water communication path is located downstream of a contact point between the dampening roller and the second oscillating roller, the first oscillating roller not being in rotational contact with the inking rollers, said inking rollers being in rotational contact with the printing plate.

2. A dampening unit in an offset printing press as set forth in claim 1, characterized in that said roller in rotational contact with said dampening roller is a distributing roller.

* * * * *